United States Patent [19]

Huntley

[11] 4,059,299

[45] Nov. 22, 1977

[54] AUXILIARY PORTABLE LOCK

[76] Inventor: Orville P. Huntley, 15254 Calle Juanita, San Diego, Calif. 92129

[21] Appl. No.: 663,542

[22] Filed: Mar. 3, 1976

[51] Int. Cl.[2] ..... E05C 19/18

[52] U.S. Cl. ..... 292/294; 70/14; 116/8; 116/77; 340/274 R; 70/DIG. 49

[58] Field of Search ..... 70/14, 102, DIG. 49; 292/288–298, 258, 276, 155; 340/274 R; 116/8, 77

[56] References Cited

U.S. PATENT DOCUMENTS

| | | | |
|---|---|---|---|
| 372,645 | 11/1887 | Tweeddale | 292/155 |
| 445,273 | 1/1891 | Hise | 292/295 |
| 759,673 | 5/1904 | Coleman et al. | 292/294 |
| 1,864,883 | 6/1932 | Anderson | 70/14 |
| 3,181,319 | 5/1965 | Hudon | 70/14 |
| 3,938,839 | 2/1976 | Collier | 292/288 |

*Primary Examiner*—Paul R. Gilliam
*Assistant Examiner*—Kenneth J. Dorner
*Attorney, Agent, or Firm*—Ralph W. Kalish

[57] ABSTRACT

An auxiliary portable lock which comprises a housing, a lock body receivable within said housing, and adapted for axial rotation therein, said housing being internally communicative with a tubular casing axially normal to the longitudinal axis of said housing and being open at its opposite ends. There is an elongated locking bar having a serrated surface provided for extension through said tubular casing and having integrally formed at one of its ends, a door-engaging portion. A cooperative serrated member is provided within said housing for movement toward and away from the confronting portion of said locking bar for maintaining same in selected disposition; said cooperative serrated member is operatively engaged to said lock body which latter, through rotative movement effects translation of said cooperative serrated member. A door engaging element is formed at one end of said tubular casing. Key control components are provided to secure said lock body to said housing. An anti-distortion device is detachably mounted upon said lock body for indicating unauthorized linear or rotative movement thereof.

Another version of the lock of this invention embodies cooperating clamping components interengaged by an elongated screw operatively manipulated by said lock body whereby said clamping components may be drawn toward each other, on opposite sides of aligned doors to retain same in closed condition.

14 Claims, 29 Drawing Figures

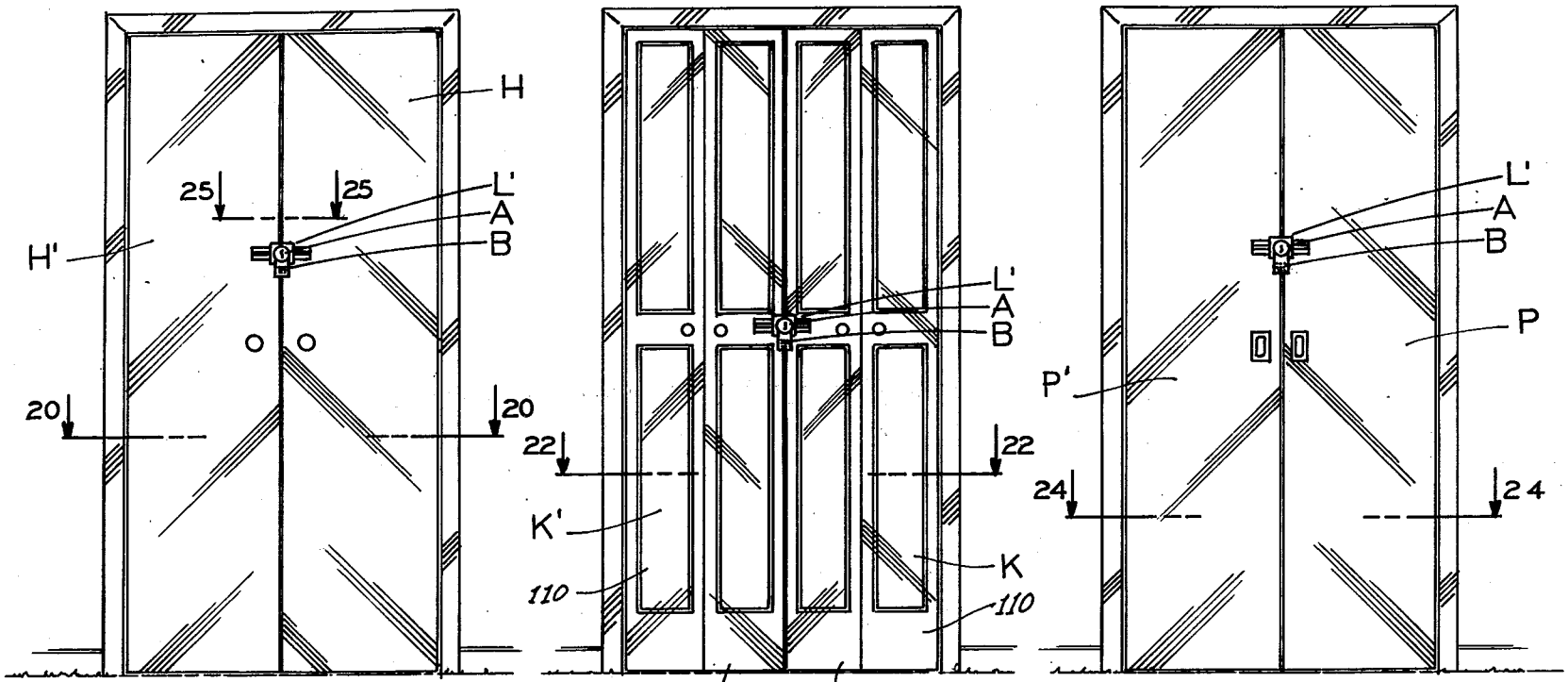
FIG. 19
FIG. 21
FIG. 23
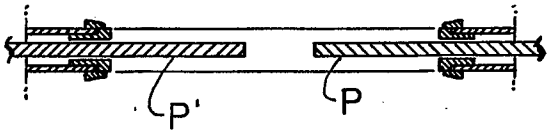
FIG. 24
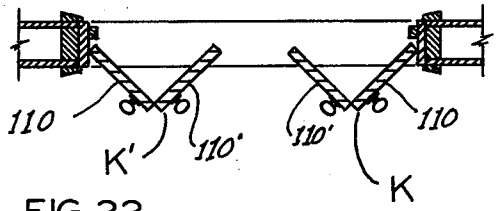
FIG. 22
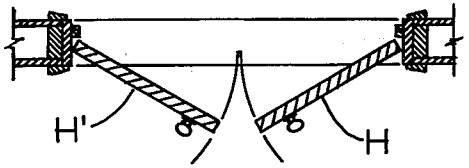
FIG. 20

AUXILIARY PORTABLE LOCK

BACKGROUND AND SUMMARY OF THE INVENTION

This invention relates in general to locks and, more particularly, to a portable auxiliary lock for detachable mounting upon various types of doors for enhancement of security.

With the admitted, relatively elevated crime rate in this Country at the present time, considerable efforts have been, and are being, made to develop locking devices which may be utilized upon doors which are even equipped with permanently mounted locks. Such efforts have been directed at frustrating the unauthorized entry through such doors by individuals having the capability of effecting the opening of the permanent lock. Numerous of the supplemental locks are applicable for only a certain type of door and thus do not possess the desired versatility so that a user may have to obtain a collection of such auxiliary locks in order to accommodate the various types of door arrangements, such as, sliding doors, folding doors, as well as the usual swinging doors. Additionally, such supportive locks should be of sufficiently uncomplicated and light construction so that they may be readily transported by the user for application at numerous locations and without requiring any developed skill on the part of the user.

Therefore, it is an object of the present invention to provide an auxiliary portable lock which embodies basic operating components for facile cooperation with coordinating elements for effectiveness with the various types of doors one encounters in one's daily life.

It is another object of the present invention to provide an auxiliary portable lock of the character stated which by reason of incorporating a common basic construction conduces to marked economy in production.

It is a still further object of the present invention to provide a lock of the character stated which is of simple construction; and which is usuable by the average individual in a fully reliable manner and, hence, obviates the need for specialized skills.

It is another object of the present invention to provide a lock of the character stated which is of compact character and, hence, easily transported by the user so that it is extremely versatile in that it is particularly suited for travelers whereby motel and hotel room doors may be accorded increased security to the tranquility of the user.

It is a further object of the present invention to provide an auxiliary protable lock of the character stated which is designed to incorporate a sound emitting device presenting an audible alarm signal in the event such lock is subject to tampering.

It is a still further object of the present invention to provide a lock of the character stated which may be most economically manufactured; the use of which does not require any modification or, hence, damage to the door or other closure upon which the device is used; and which is reliable and durable in usage.

DESCRIPTION OF THE DRAWINGS

FIG. 19 is a front view of another form of auxiliary portable lock constructed in accordance with and embodying the present invention illustrating same upon a pair of swingably mounted doors, openable toward or away from one.

FIG. 20 is a horizontal transverse sectional view taken substantially on the line 20—20 of FIG. 19 which illustrated the path of swing of the doors illustrated in FIG. 19.

FIG. 21 is a front view of folding doors in closed condition having mounted thereon the lock illustrated in FIG. 19.

FIG. 22 is a horizontal transverse sectional view taken substantially on the line 22—22 of FIG. 21 illustrating the path of movement of the folding doors.

FIG. 23 is a front view of a pair of normally abutting sliding doors having mounted thereon the lock shown in FIG. 19.

FIG. 24 is a horizontal transverse sectional view taken substantially on the line 24—24 of FIG. 23 but illustrating the doors in partially open condition.

DESCRIPTION OF PRACTICAL EMBODIMENTS

Figure 1:
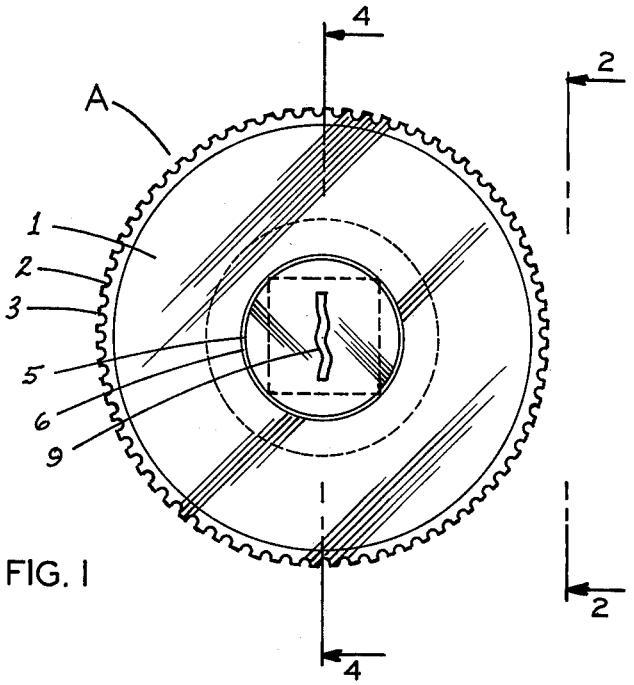
FIG. 1 is a front view of a lock body of an auxiliary portable lock constructed in accordance with and embodying the present invention.
Figure 2:
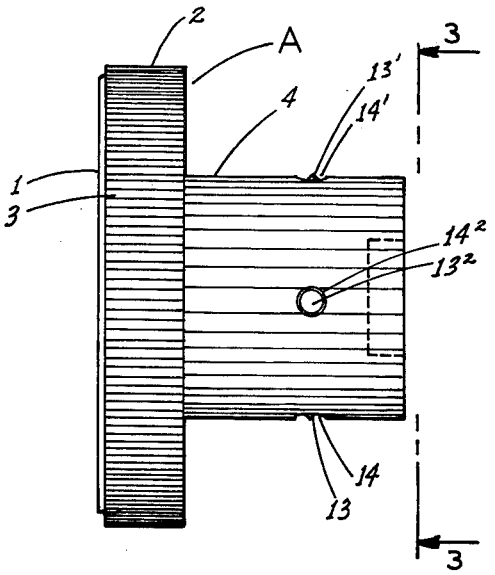
FIG. 2 is a side elevational view taken on the line 2—2 of FIG. 1.
Figure 3:
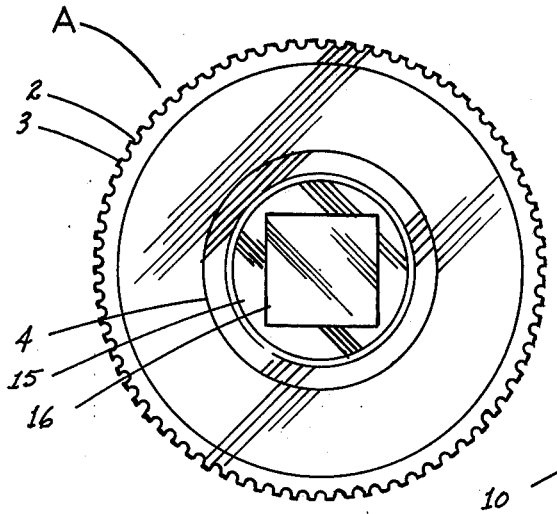
FIG. 3 is a rear view taken on the line 3—3 of FIG. 2.
Figure 4:
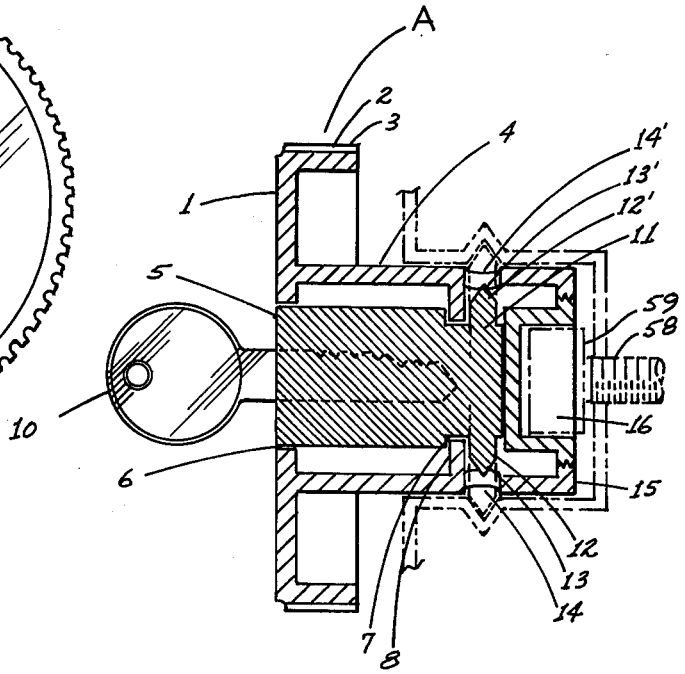
FIG. 4 is a vertical transverse sectional view taken on the line 4—4 of FIG. 1.

Referring now by reference numerals to the drawings which illustrate practical embodiments of the present invention, A designates a lock body which constitutes the locking and turning mechanism of the auxiliary portable lock L (see FIG. 8) of the present invention; said body being useful with a variety of components for rendering the present invention useful for enhancing security by application to a plurality of door types. Lock body A integrally incorporates a relatively enlarged annular forward end plate 1 having a rearwardly extending peripheral skirt or flange 2 which, on its outer surface, is serrated, as at 3. Extending rearwardly from plate 1, radially inwardly of flange 2, and concentric therewith, is a cylindrical casing 4 for accommodating a barrel 5, the forward end of which is received within an opening 6 formed centrally in end plate 1 and with the forward end of barrel 5 being substantially flush with the outer surface of end plate 1. Proximate its rearward end, barrel 5 is provided with a circumferential recess 7 within which extends an annular inturned stop flange 8 integral with casing 4; said inturned flange 8 thus limiting axial movement of barrel 5. Said barrel 5 at its forward end is provided with a keyhole 9 for insertion therein of a control key 10 which, upon turning, is adapted to coact with cams (not shown) for operating spring-pressed tumblers (not shown) to cause locking or unlocking movement, as the case may be, of bolt-like elements 11, such as arms or prongs, as indicated at 12,12', each of which is preferably tapered at its outer end extremity, as at 13,13', respectively. Although two of such arms 12,12' are indicated in FIG. 4, it is understood that there may be four of such arms arranged at 90° intervals, or there may be only two such arms which would be diametrally opposed. Three of four such arms, as at $13^2$ and $14^2$ are shown in FIG. 2. By means of the particular selected mechanism within barrel 5, arms 12,12' will, upon turning of key 10 in one direction, be caused to extend radially outwardly through apertures, as at 14,14', formed in casing 4 immediately rearwardly of flange 8 for purposes presently appearing; or by reverse movement of said key 10, the same will be caused to retract from such extended movement and be returned within casing 4 into the condition illustrated in FIG. 4. It should be understood that the means for effecting reciprocal action of arms 12,12' does not form a part of the present invention since the same may be done in any well known conventional manner.

Said casing 4 rearwardly of apertures 14,14' extends a short distance to its rearward end face, at 15, and centrally thereof is contoured to provide a rearwardly opening socket 16 which is preferably of quadrilateral configuration, and desirably square, for purposes presently described. However, said socket 16 may be circular, as well, and with its side walls serrated for simulating a socket wrench.

As will be shown hreeinbelow, the coordination of lock body A with a multiplicity of cooperative door locking components will be described.

Figure 7:
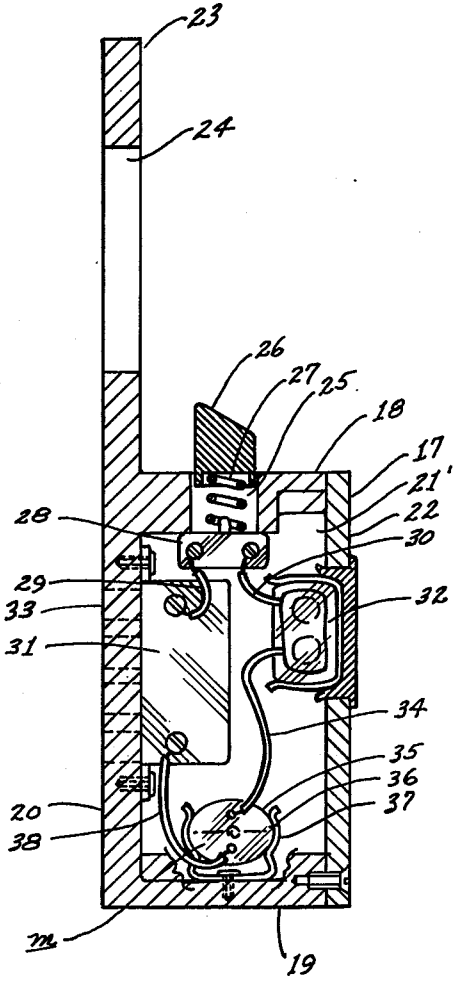
FIG. 7 is a vertical transverse sectional view taken on the line 7—7 of FIG. 5.
Figure 6:
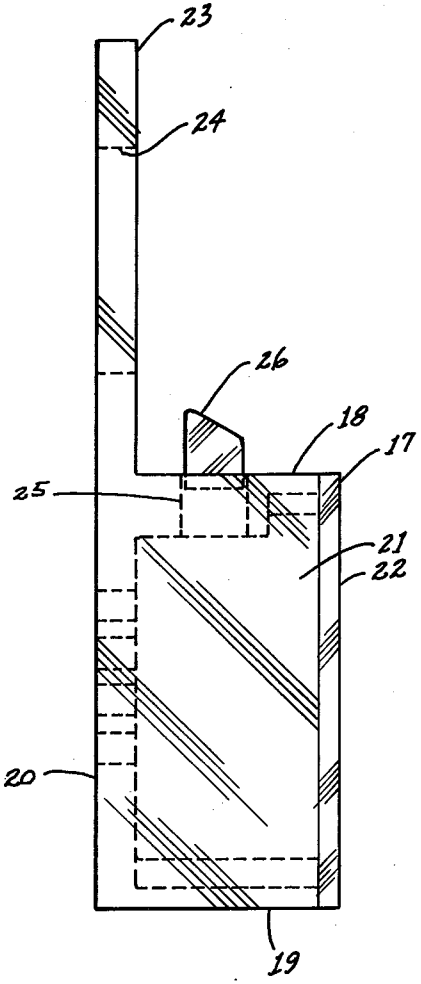
FIG. 6 is a side elevational view taken on the line 6—6 of FIG. 5.
Figure 5:
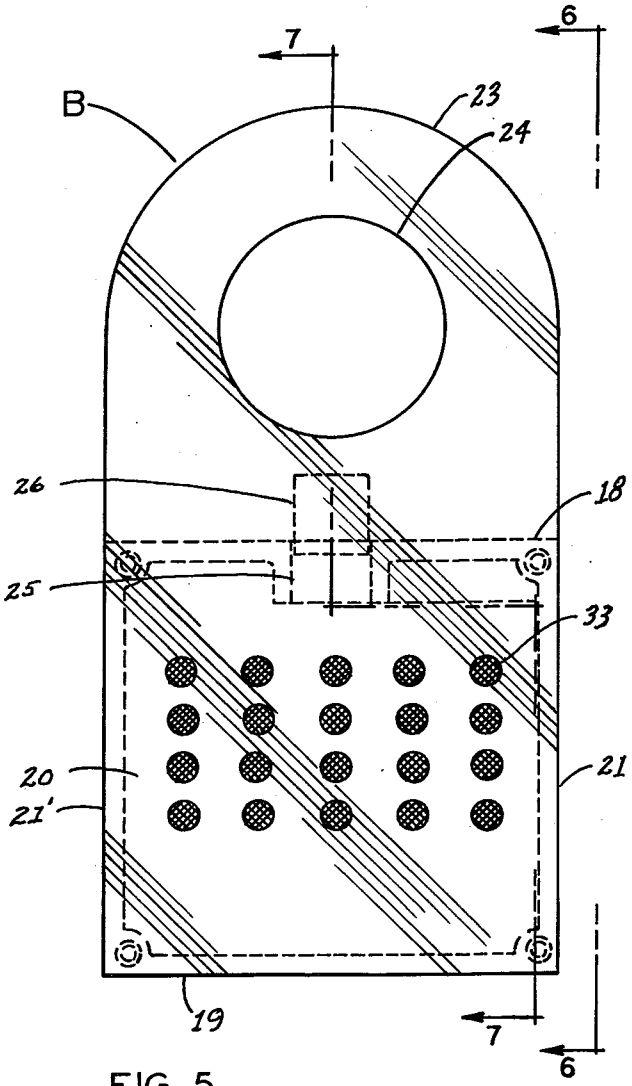
FIG. 5 is a front view of an anti-distortion device for use with the auxiliary portable lock of the present invention.

FIGS. 5, 6 and 7 illustrate an anti-distortion device, indicated broadly B, which is optionally usable with the present invention, and mountable upon lock body A at the user's election. Said anti-distortion device B comprises a housing 17 having a top wall 18, bottom wall 19, forward wall 20, and end walls 21,21'; there being a removable closure plate 22 serving as the rear wall. Said forward wall 20 is integral at its upper end with a plate 23 which extends a predetermined distance above top wall 18 and is provided with an enlarged opening 24 through which casing 4 of the lock body A is receivable, as suggested in FIG. 8, so that housing 17 will be suspended from said casing 4 and with plate 23 being rearwardly of end plate 1. The front to back determination of housing 17 is such as to avoid any interference with extension of arms 12,12' through casing openings 14,14'.

Formed on the upper wall of housing 17 is an opening 25 for receiving a button-like switch element 26 which is biased by a spring 27 into normally upwardly extended position (see FIGS. 6 and 7) engaged within opening 25. At the lower end of said opening 25 there is provided a plate 28 having conductive switch elements (not shown) which are connected by relatively short leads 29,30 to what is commonly referred to as a squawk or screamer box, and one side of a battery 31, 32, respectively; the former being mounted upon the inner face of wall 20 and the latter being suitably carried upon the inner face of closure 22. As indicated, said squawk or screamer box is of conventional design and adapted to cause the emission of an audible signal through a multiplicity of openings 33 formed in forward wall 20. Battery 32 is connected by a lead 34 to one side of a mercury switch 35 comprising a casing 36 held within a mounting or clip-like structure 37 secured to bottom wall 19. The other side of switch 35 is connected by a conductor 38 to one side of screamer box 31. Casing 36 contains a quantity of mercury, as at *m*, such that the point of connection of lead 34 will be in normal circuit-open condition. With device B engaged upon lock body A, flange 2 of the latter will maintain element 26 in downward, circuit-closing condition against the bias of spring 27.

Figures 8, 9, 10:
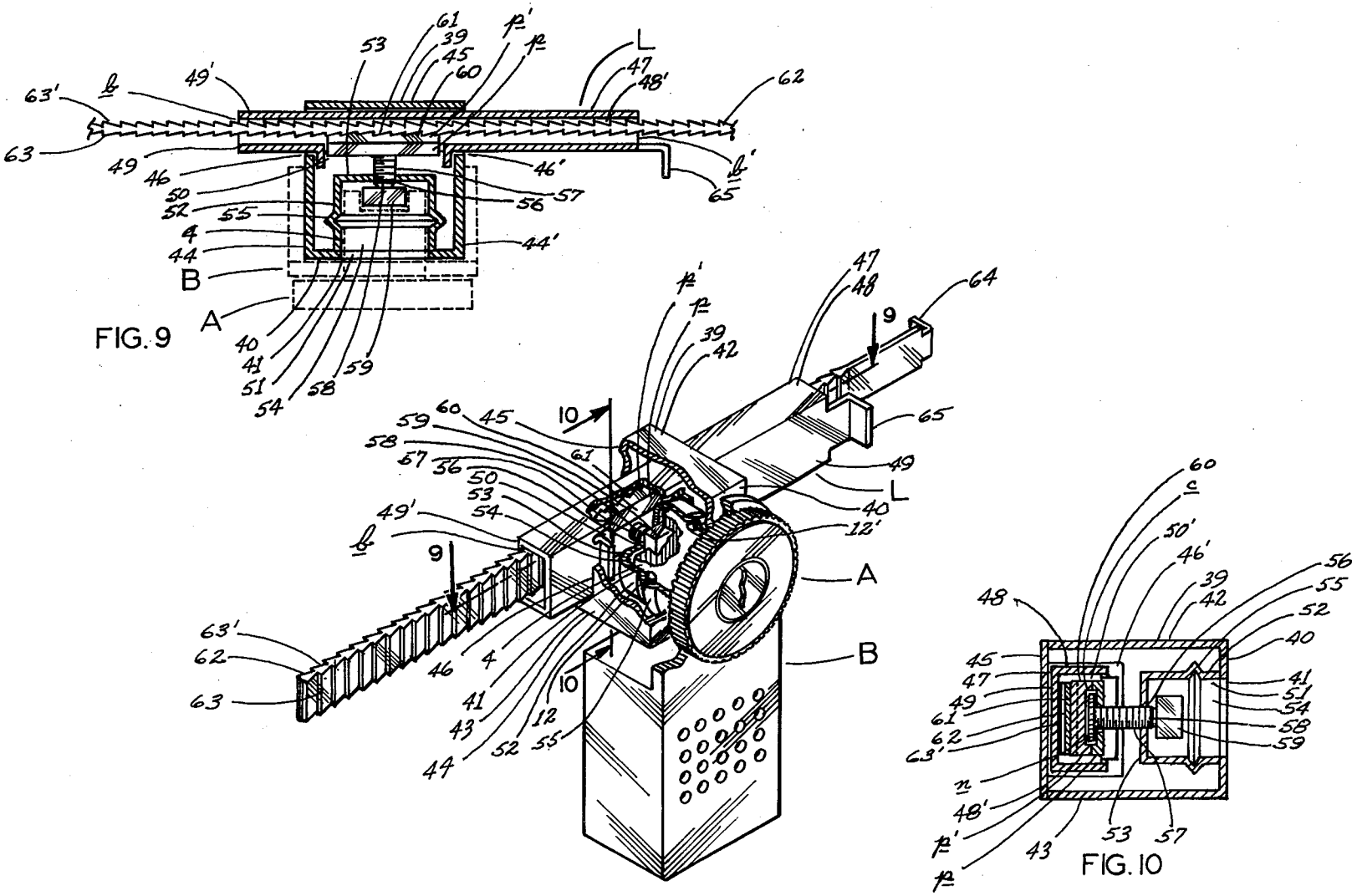
FIG. 8 is a perspective view, partially broken away, of another form of auxiliary portable lock constructed in accordance with and embodying the present invention.
FIG. 9 is a horizontal transverse sectional view taken on the line 9—9 of FIG. 8.
FIG. 10 is a vertical transverse sectional view taken on the line 10—10 of FIG. 8.

In actual usage, if one were to tamper with device B, or to cause the same to be swung out of normal vertical disposition, as shown in FIG. 8, mercury *m* within casing 36 would be caused to flow over the point of contact with lead 34 and thereby close the circuit between lead 34 and conductor 38 for energizing the squawk box 31 so that said latter will issue an audible alarm. Thus, device B is exceedingly simple in construction and being readily engageable with lock body A and serves to enhance the security provided thereby. As will be shown more fully hereinbelow, device B is useful with the various applications of auxiliary lock L. It should be apparent that mercury switch 35 is but one of various types of gravity actuated switches which might be utilized, and is, hence, set forth for exemplary purposes. Also screamer box 31 could be replaced by any other type of audible signaling device, such as a buzzer or bell, as well as by a visual signal, such as a lamp, or light, without departing from the scope of this invention.

Turning now to FIGS. 8, 9, and 10, an application of auxiliary portable lock L embodying lock body A is shown. Like reference numerals will be utilized, for purposes of comprehension, with respect to like components hereinabove described. The casing 4 of lock body A is received within a housing 39 comprising a front wall 40 with an enlarged central aperture 41 through which said casing 4 extends, top and bottom parallel walls 42,43, side walls 44,44', and a rear wall 45; said side walls 44,44' being provided with enlarged openings, as at 46,46', respectively, in their rearward portions for extension therethrough of an elongated, sheath-like casing or tube 47 being quadrilateral in cross-section having top and bottom walls 48,48', respectively, and forward and rearwad walls 49,49'; said casing 47 being fixed within said openings 46,46' thereby being rigid and unitary with housing 39 which is located adjacent one end of said casing 47. Casing 47 is open at its opposite ends, as at *b,b'* and in its forward wall 49 is provided with a reactangular opening 50 establishing communication between the interior of casing 47 and housing 39. Integrally formed with housing 39 and extending inwardly from front wall aperture 41 is a socket-forming receptacle 51 having a cylindrical side wall 52 and inner end or base wall 53 or developing a chamber 54 within which lock body casing 4 extends; there being a radially outwardly projecting, annular protuberance 55 for receiving arms 12,12' of lock body A when in extended condition. Inner wall 53 of receptacle 51 is provided centrally with an tapped or internally threaded opening 56 through which engagingly extends the forward end of the threaded stem 57 of a drive screw 58 having an enlarged cube-like head 59 received within chamber 54 for acceptance within socket 16 of lock body A. (see FIGS. 4, 8, and 9) It is to be observed that screw head 59 snugly fits within socket 16 from the standpoint of cross-section so that upon rotation, casing 4 will act as a wrench to cause coincident axial turning of screw 58 for threading and unthreading purposes for reasons to be shown. The depth of socket 16 is greater than the thickness of screw head 59 (see FIGS. 4 and 9) so that sufficient room is provided for axial travel of screw 58 as the same is manipulated.

The inner or opposite end of stem 57 of drive screw 58 is extensible through opening 50 and on its proximate extremity is engaged to a relatively enlarged disc *n* accepted for rotative movement within a chamber *c* formed within a compressor plate assembly 60 constituted of mutually secured coordinating plates *p,p'*, the major dimension of which is parallel to the longitudinal axis of casing 47 and with the rearward face of plate *p,p'* being serrated at 61. The connection between said compressor plate assembly 60 and screw 58 is of the loose-running swivel character so that rotation of screw 58 will cause corresponding movement of said assembly 60 toward and away from receptacle 51. The relative dimensions are such that when screw 58 is in fully drawn forward position, the serrated face of plate *p'* will be substantially flush with the inner face of wall 49 of casing 47 adjacent opening 50.

Extending through casing 47, for relative axial movement therein, is an elongated locking bar or latch element 62 being provided with serrations or ratchet teeth 63,63' on its forward and rearward faces, respectively, which are formed for interengagement with the cooperating serrations or teeth 61 on compressor plate assembly 60. At one of its ends said element 62 is provided with a tongue 64 axially normal to the longitudinal axis of element 62 and projecting in the direction toward rearward serrations 63' or away from lock body A. The forward wall 49 of casing 47 at its end corresponding to the portion of locking bar 62 carrying tongue 64 is provided with a forwardly turned flange 65 extending in a direction opposite to that of said tongue 64.

As may best be seen in FIG. 8, lock body A has engaged thereon anti-distortion device B as above described.

From the foregoing it will thus be seen that with drive screw head 59 accepted within socket 16 of lock body A, upon turning of the latter in one direction, said screw 58 will be threaded rearwardly to cause the compressor plate assembly 60 to be moved toward locking bar 62 into the interior of casing 47 to cause the teeth or serrations 61 of plate *p'* of the former to engage the opposed teeth or serrations 63 of bar 62, which shall have been shifted relatively axially of casing 47 for the particular application, as will be shown below; thereby rigidly interconnecting lock body A with housing 39 to locking bar 62. With such interengagement established, the user may then secure lock body A by appropriate manipulation of key 10. The unlocking operation is obviously the reverse in that after unlocking said body A, the entire unit is turned to effect unthreading of screw 58 for disengagement of bar 62 which is then released for detachable slideable movement through casing 47, all of which will become more apparent hereinbelow. It may be noted that casing 47 is of such cross-sectional dimension for close acceptance of locking bar 62 so that the travel of compressor plate assembly 60 between engaged and disengaged condition is quite limited.

Figure 11:
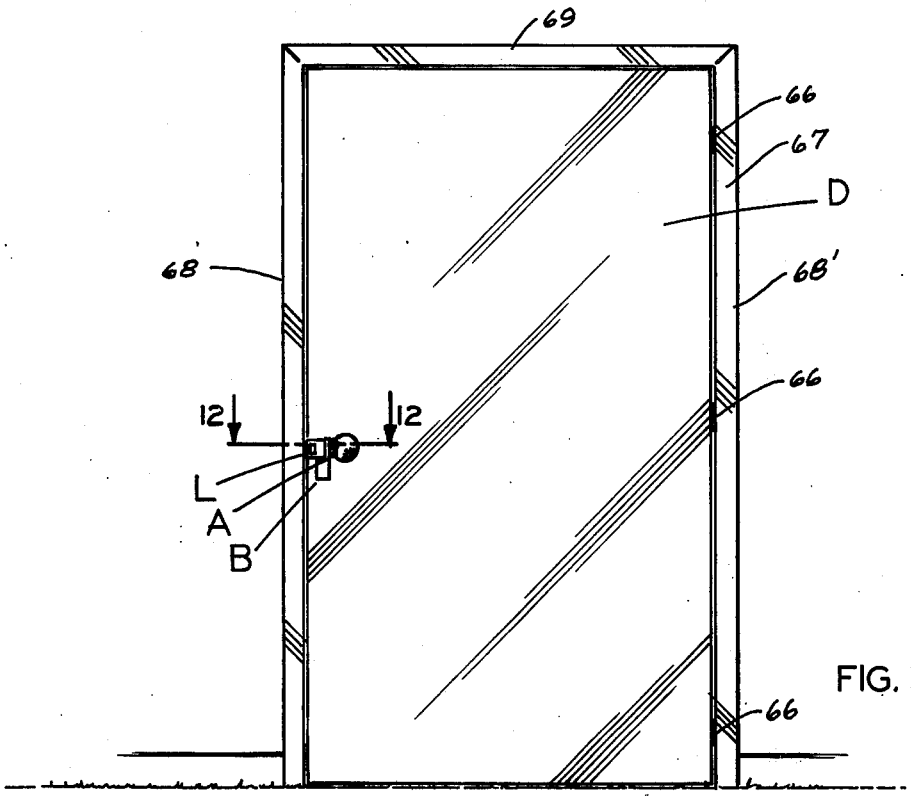
FIG. 11 is a front view of the lock shown in FIG. 8 as disposed in operative position in connection with a swinging door, of the type swinging toward the operator.
Figure 12:
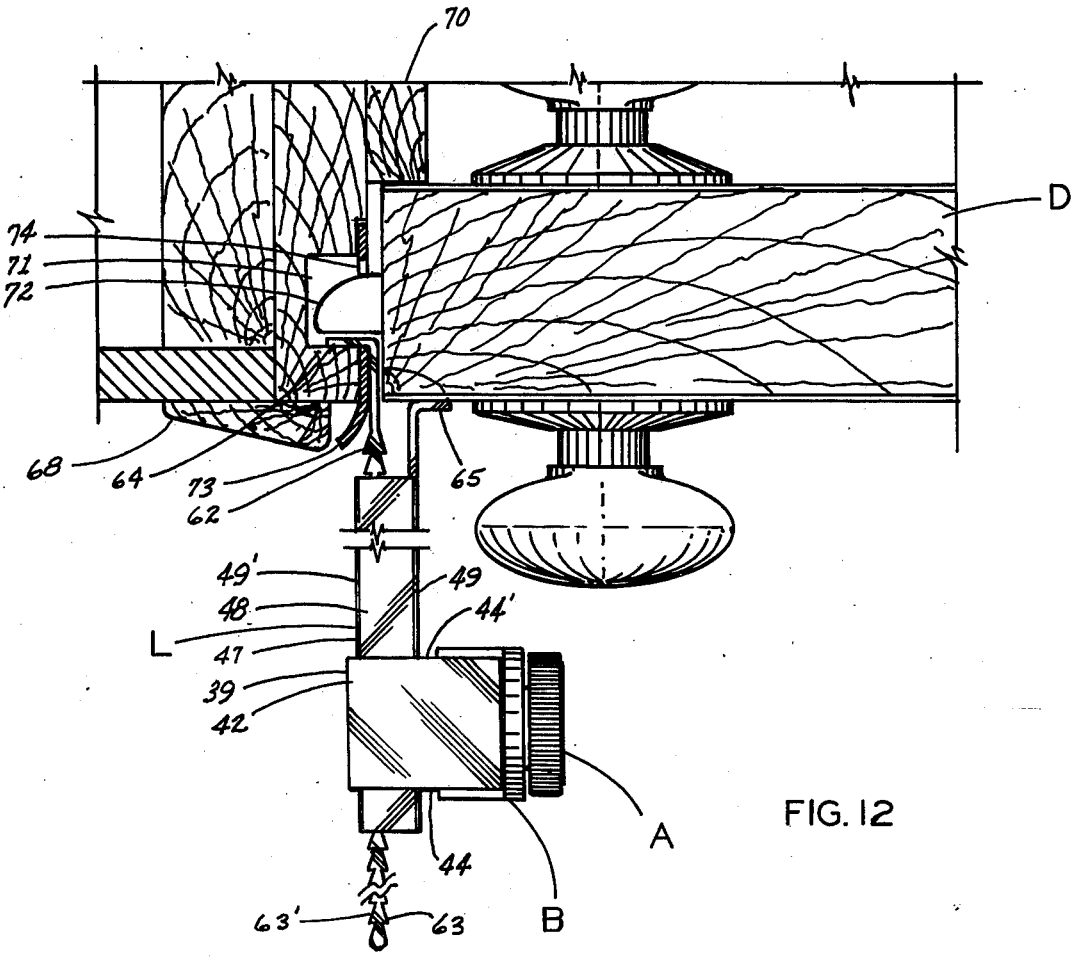
FIG. 12 is a top plan view, in partial section, taken on the line 12—12 of FIG. 11.

Referring now to FIGS. 11 and 12, auxiliary lock L, together with the associated components illustrated in FIGS. 8, 9, and 10, is shown as being applied for use with a conventional swinging door of the type which opens toward the user. It is understood that like reference numerals will be utilized for like components for the sake of brevity. D indicates a door disposed for swinging in a direction toward one as by hinges 66 within a door frame 67 having opposed jamps 68,68' and a header 69. Carried on jamb 78 is a stop shoulder 70 for engaging the normally inner free end portion of door D for limiting its movement into closed position and with there being a latch box or keeper 71 formed in jamb 68 for receiving the usual spring pressed latch bolt 72 carried on door D. Engaged on jamb 68 is the customary strike plate 73 having an opening 74 registering with latch box 71.

It will be seen that in order to provide enhanced securement of door D, tongue 64 of locking bar 62 is inserted within latch box 71 against the outer side wall thereof so that said bar 62 will project outwardly in axially parallel relation to the plane of door D when the same is in closed condition (see FIG. 12). Lock body A together with the associated housing 39 in casing 47 is then shifted along bar 62 until the end face of flange 65 abuts against door D which has been brought into closed condition. With said flange 65 so engaged, lock body A is then suitably turned to effect tight engagement of compressor plate 60 and bar 62 and thereupon said lock body A is latched by operation of key 10. It will be noted that door D is thereby most reliably restrained against unauthorized opening movement. Flange 65 provides what might be considered a pushing force against door D, while the engaged lock bar 62 presents a pulling force against jamb 68 in the opposite direction whereby such forces coact to bring about the requisite security.

Figure 13:
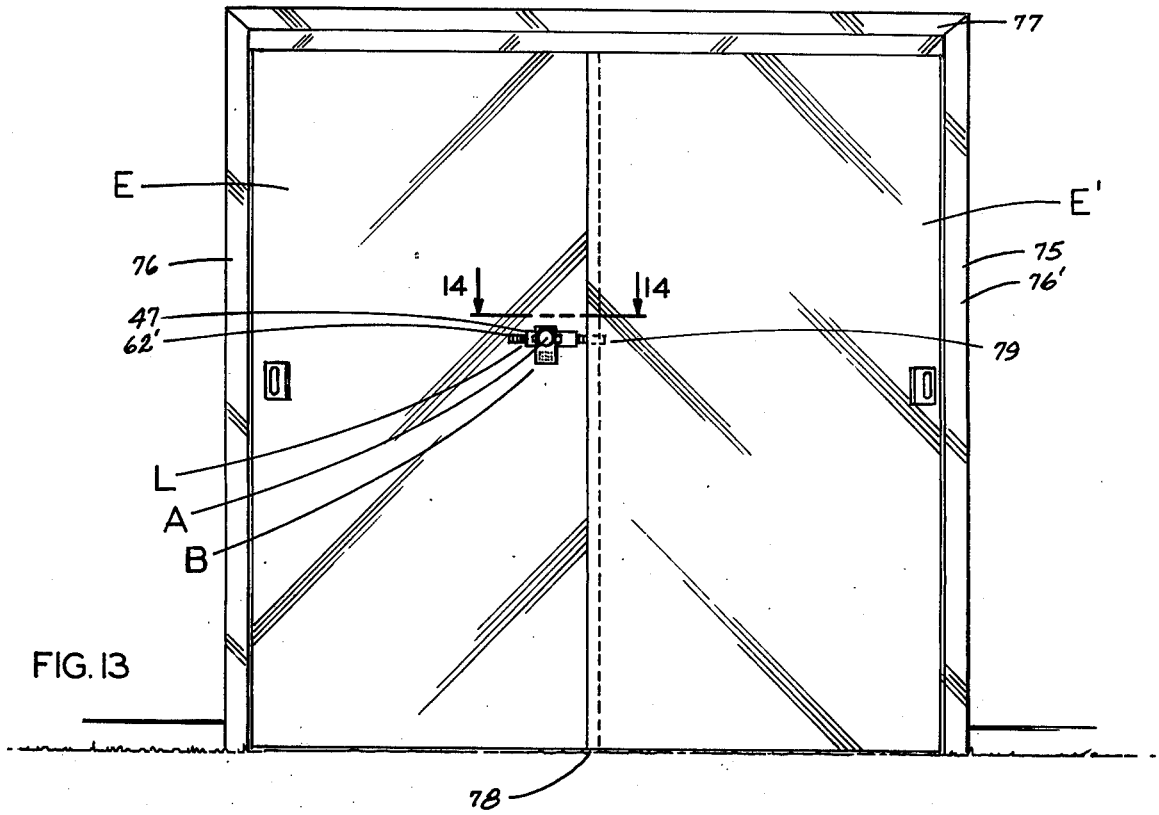
FIG. 13 is a front view of another form of auxiliary portable lock constructed in accordance with and embodying the present invention, illustrating the same as disposed for use with mutually slideable doors.
Figure 14:
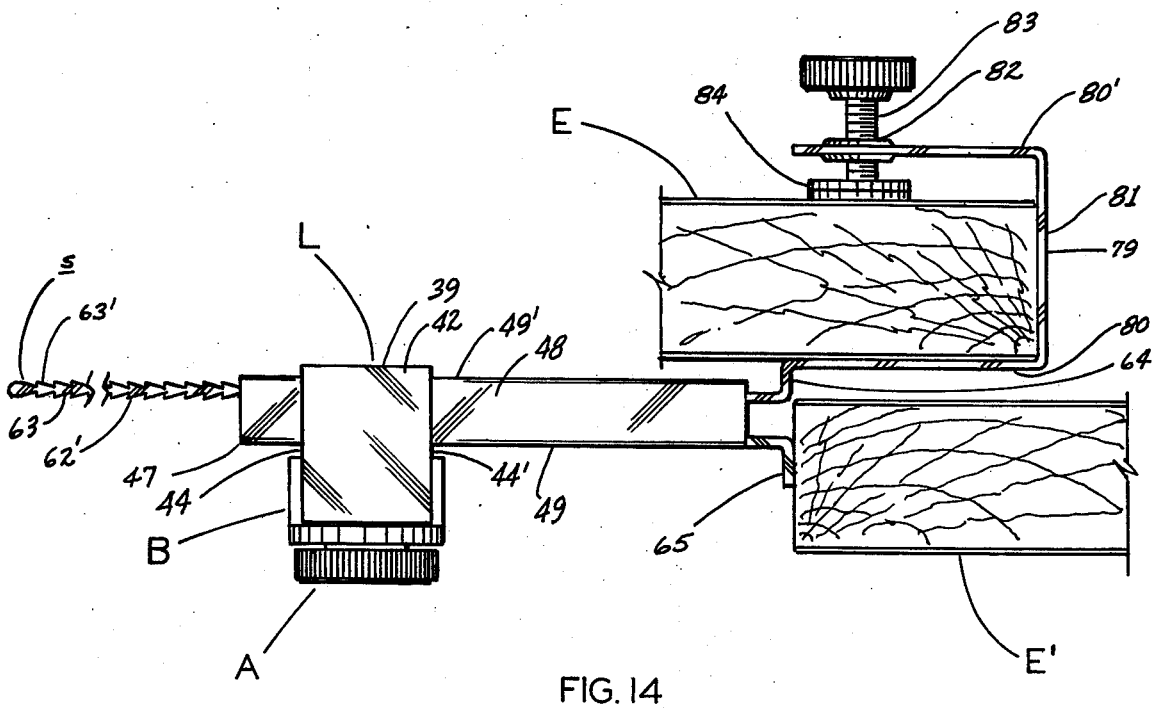
FIG. 14 is a top plan view, partial section, taken on the line 14—14 of FIG. 13.

Turning now to FIGS. 13 and 14, E,E' indicate cooperative sliding doors of the non-butting or offset type being relatively movable within parallel tracks as formed within a door frame 75. Said doors E,E' will be in limited overlapping condition when closed. Door frame 75 contains jambs 76,76', header 77, and base 78, For maintaining doors E,E' in closed, locked condition, the auxiliary lock of the present invention may be utilized, with like reference numerals referring to like components for facilitating description of the invention. Thus there is provided with use with lock body A and casing 47 a lock bar 62' which contains a serrated or ratcheted portion, as *s*, corresponding to serrations 63,63' of bar 62', but which integrally contains a reversely bend end portion 79 which is continuous with tongue 64; said end portion 79 containing parallel front and back rearward legs 80,80' and an interconnecting web 81 perpendicular to said legs 80,80'. Leg 80 which has a length substantially equal to the extent of the overlap of doors E,E' when in closed condition is disposed for abutment on its inner face against the confronting forward portion of door E, while web 81 abuts on its inner face against the adjacent end surface of door E. Web 81 is of greater length than the transverse extent of said door end face so that leg 80' is presented spacedly rearwardly of the rearward face of door E. Proximate its free end, leg 80' is tapped, as at 82, for engaging the threads of a clamping screw 83 having an enlarged disc 84 at its head remote end for effecting snug, frictional engagement with door E to thereby maintain bar 62' in operative position. Although disc 84 may be rigid with screw 83, for turning therewith, such might cause defacing of door E upon tightening. Therefore, it desired, said disc 84 in lieu of being integral, may be of two part construction having a central chamber (not shown) to provide a loose swivel connection as in the manner of compressor plate assembly 60 above described. Thus, upon presentation of flange 65 against the adjacent end surface of door E' (FIG. 14) lock body A is appropriately manipulated to effect latching engagement by the compressor plate assembly 60 and locking bar 62' thereby maintaining said doors E,E' in reliably closed condition. Flange 65 serves to effect a pushing against door E' to urge same at its opposite end against jamb 76' while reversely bent end portion 79 is caused to effect a pulling upon door E for prejudicing same against jamb 76. The present invention is uniquely useful with sliding doors of the type exemplified by doors E,E'. Auxiliary lock L is secured in position by moving the doors E,E' into respectively substantially full open condition so that the handle remote side edge of door E is readily accessible for engaging thereon of locking bar 62', with appropriate tightening of screw 83. Thereon the doors E,E' are returned to closed condition and casing 47 and the associated structure secured thereon.

Figure 15:
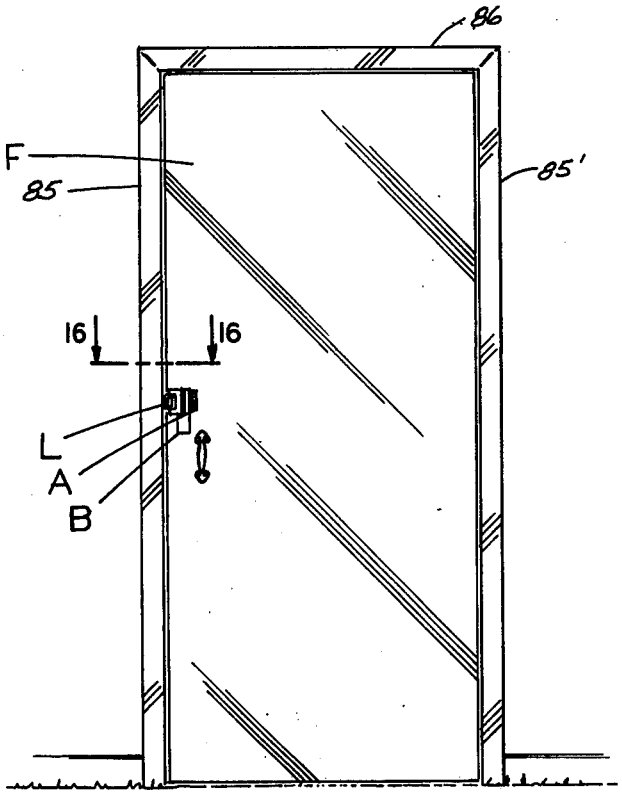
FIG. 15 is a front view of a still further form of auxiliary portable lock constructed in accordace with and embodying the present invention.
Figure 16:
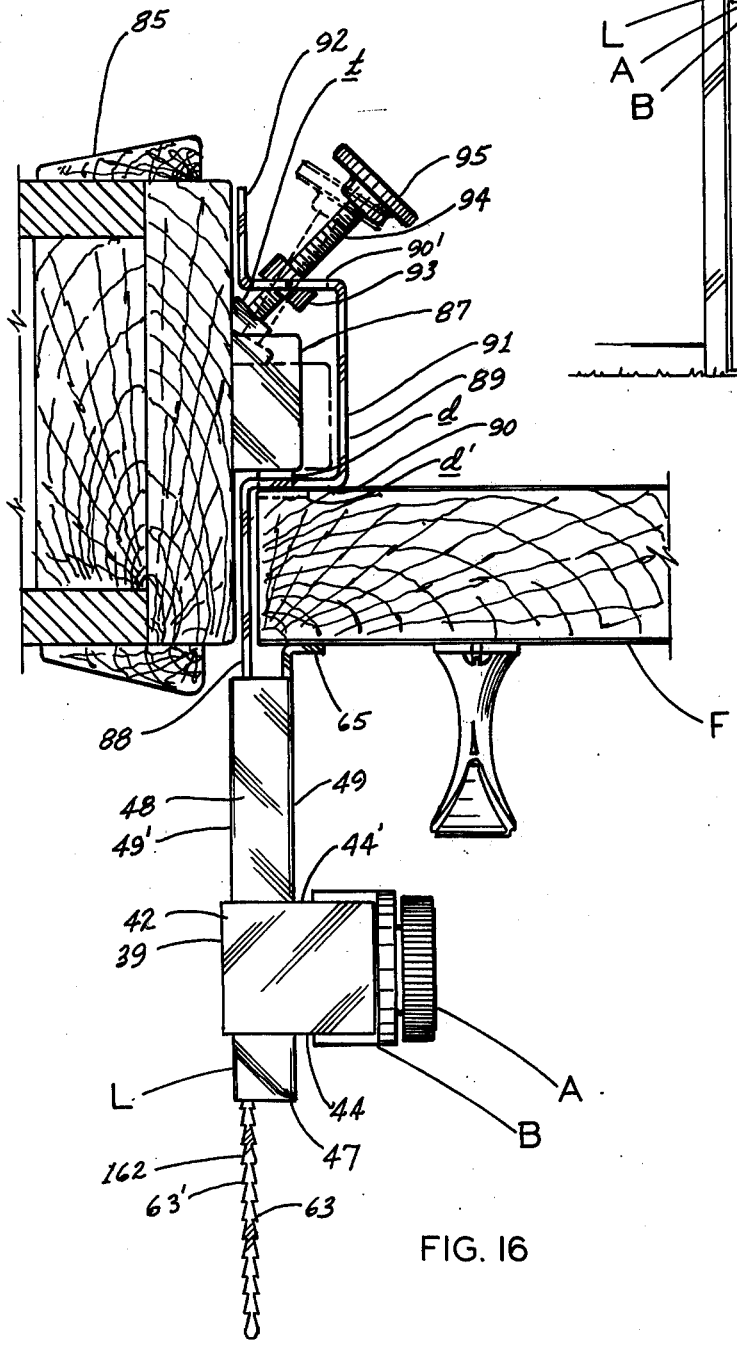
FIG. 16 is a top plan view, in partial section, taken on the line 16—16 of FIG. 15.

Referring now to FIGS. 15 and 16, F indicates a door hingedly mounted along one vertical side within a door frame comprising jambs 85,85' and header 86. Fixed upon jamb 86 is the customary stop shoulder 87 for limiting inward swinging movement of door F when in closed condition. As will be observed door F and the associated frame are devoid of the customary latch-keeper arrangement but are of the magnetic catch-type wherein cooperating magnetic components *d,d'* are provided upon said door F and shoulder 87. The auxiliary lock of the present invention is readily adapted for utilization with the present invention, it being understood that like reference numerals will refer to like components; all of such components being identical with those hereinabove described, with the exception of lock bar 162 which differs from lock bar 62 in comprising at its portion adjacent flange 65 an elongated coaxial portion 88 of such length as to extend slightly beyond the inner face of door F when in engaged condition. Continuous with said coaxial portion 88 is a reversely bent terminal 89 comprising planar parallel forward and rearward arms 90,90' which are parallel to the plane of door F and with the same being of such extent so as to project laterally beyond stop 87, whereby an intervening web 91, which is axially parallel to coaxial portion 88, is presented spacedly from said shoulder 87. Web 91 is of greater length than the forward to rearward dimension of shoulder 87 so as to present arm 90' spacedly inwardly thereof. At the web remote end of arm 90' is a flange 92 which is substantially coaxial with the portion 88 and planar parallel to the confronting face of jamb 85. Arm 90' is of such transverse extent as to be provided with an opening within which is swivelly mounted a nut 93 for threadably receiving the stem 94 of an enlarged retaining screw 95. A ball swivel device *t* may be affixed on the head remote end of said screw 95 to avoid scarring of the engaged portion of the door jamb.

From the foregoing it will be seen that lock bar 162 is placed in position with door F opened so that arm 90 will be in abutment on its rearward face against magnet *d* and with arm 90' being thus located inwardly of stop 87. Screw 95 is tightened so as to cause its head remote end to be brought into frictional engagement with the rearward face of stop 87 and the adjacent portion of jamb 85. Door F is then brought into closed condition whereby coaxial portion 88 of lock bar 162 is disposed between the inner end face of said door F and jamb 85. Thereupon casing 47 is moved along lock bar 162 until flange 65 is brought into abutment against the proximate portion of the outer face of door F. Thereon lock body A is manipulated to effect engagement between compressor plate 60 and lock bar 162, in the manner above described, and then secured in such condition by use of key 10. It will thus be seen that door F is dependably maintained in condition against unauthorized opening.

Figure 17:
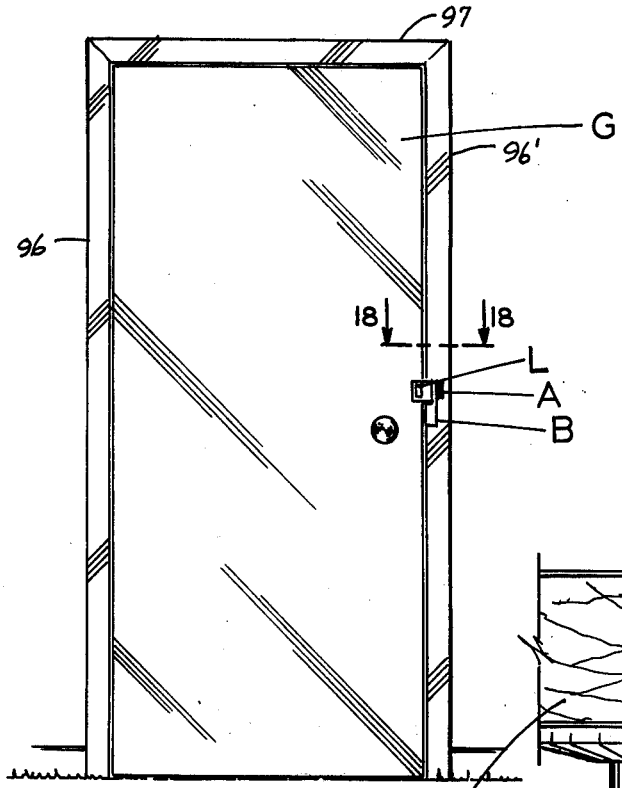
FIG. 17 is a front view of a still further form of auxiliary portable lock constructed in accordance with and embodying the present invention illustrating the same in operative position upon a swinging door, opening away from one.
Figure 18:
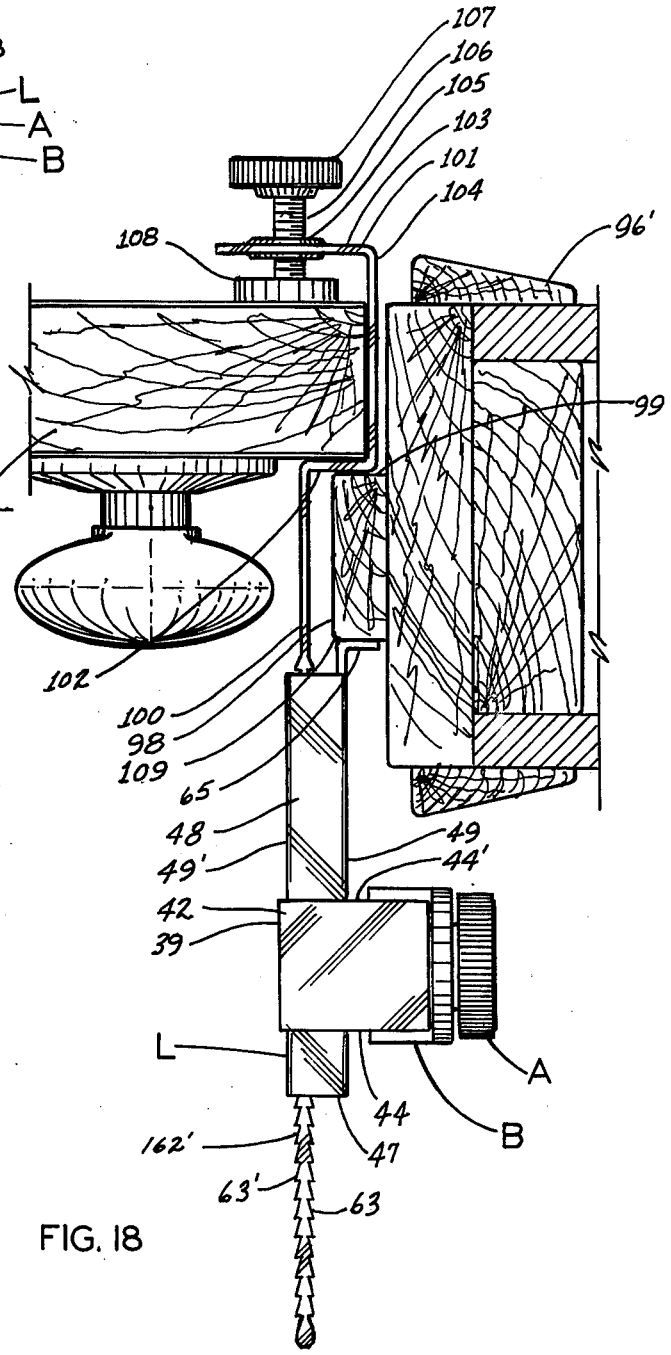
FIG. 18 is a top plan view, in partial section, taken on the line 18—18 of FIG. 17.

Referring now to FIGS. 17 and 18, G identifies a door hingedly mounted upon the jamb 96 of a door frame having a companion jamb 96' and a header 97. Jamb 96 is provided on its inner or door-opening confronting surface with a centrally located stop shoulder 98, the rearward surface 99 of which normally abuts against the forward face of door G at the end thereof remote from its hinged connection to jamb 96. Door G may be considered as of the type which would open inwardly, that is, away from the individual. The auxiliary lock of the present invention is equally useful with doors of the aforesaid type. For facilitating description, it is understood that like reference numerals will be utilized to identify like components, but with the said lock being identical to that hereinabove described, with the exception of lock bar 162' which differs from lock bar 62 in comprising a coaxial extension 100 in its portion normally adjacent flange 65 which extension is of such length as to project slightly inwardly, that is, within the door opening, of said stop shoulder 98 and with there being a reversely bent terminal 101 continuous with said coaxial portion 100 and comprising parallel forward and rearward arms 102,103, respectively, interconnected by a web 104 axially parallel to coaxial extension 100. Said rearward arm 103 is of greater extent than said forward arm 102 and said web 104 is of greater length than the thickness of door G so that said arm 103 will be presented spacedly rearwardly of said door G when the lock is in operative condition. It will be noted that terminal 101 is so presented that arm 102 extends toward jamb 96' and will be in planarwise parallel relation to flange 65. Rearward arm 103 is provided with a tapped opening 105 for threadedly engaging the stem 106 of a clamping screw 107 carrying an enlarged disc member 108 (also optionally of the alternative type and construction as disc 84 above described to avoid door scarring). at its head remote end for engagement with the rearward face of door G.

In view of the above description, the operation of auxiliary lock with door G is apparent, as lock bar 162' is placed in condition upon door G with arm 102 abutting the forward face of said door and arm 103 presented rearwardly. Screw 107 is manipulated to bring disc 108 into snug abutment against the rearward face of door G and then the door is brought into closed condition wherein arm 102 will be sandwiched between door G and rearward surface 99 of shoulder 98. Thereupon casing 47 is moved relatively along lock bar 162' until flange 65 is brought into abutment against the forward face, as at 109, of stop shoulder 98. Then lock body A is manipulated to effect engagement between compressor plate 60 and lock bar 162' and with the same being maintained against tampering by utilization of key 10. The foregoing demonstrates the versatility of the present invention by reason of its ready application to doors of the type which open away from the person.

Referring now to FIGS. 19 through 29, inclusive, another form of auxiliary lock, indicated generally L', incorporating lock body A above described, is provided for utilization with double doors which are adapted to be in abutment along confronting side edges in closed condition.

FIGS. 19 and 20 illustrate hingedly mounted, cooperating doors H,H' which may swing inwardly or outwardly, as desired, and with their free, vertical edges adapted to be in confrinting relationship when in closed condition.

FIG. 21 illustrates cooperating doors K,K' which are of the so-called by-fold character, with each containing a pair of swingably interengaged door components 110,110', respectively, with the confronting free edges of the inner components 110' being insubstantial abutment when said doors K, K' are in closed condition as shown in FIG. 21.

FIG. 23 illustrates cooperating slideably mounted doors P,P' which are of the butting type, that is, being coplanar for movement away from each other into open condition, and for movement toward each other into door closing condition. Doors P,P' differ from doors E,E' above described in that the latter are not coplanar.

Figure 25:
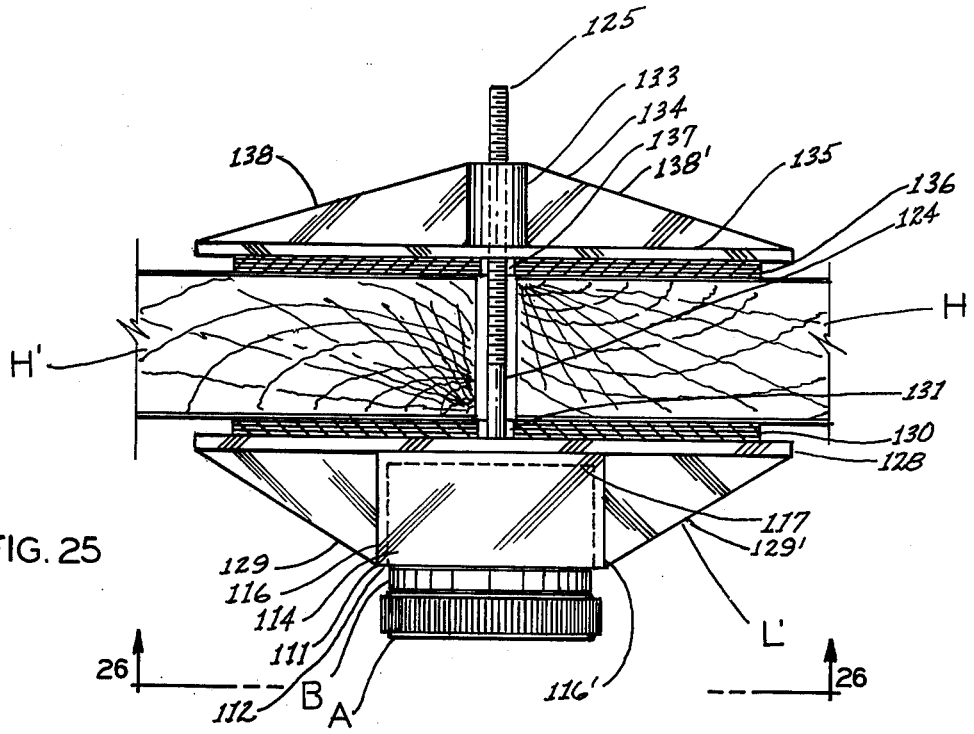
FIG. 25 is a top plan view in partial section taken on the line 25—25 of FIG. 19.
Figure 26:
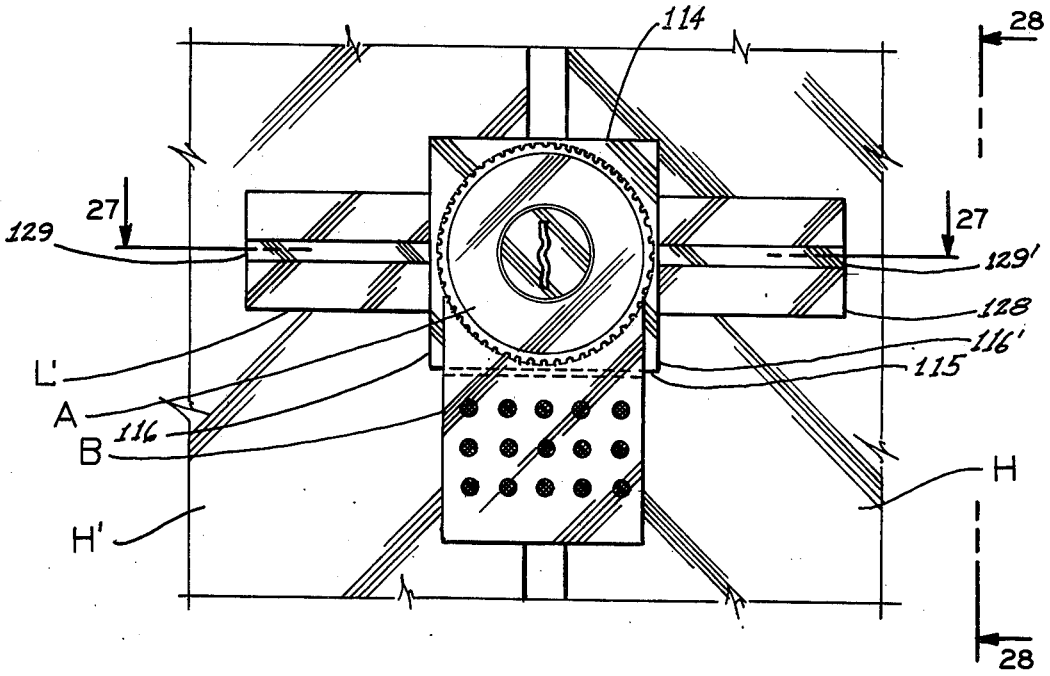
FIG. 26 is an enlarged front elevational view taken on the line 26—26 of FIG. 25.
Figure 27:
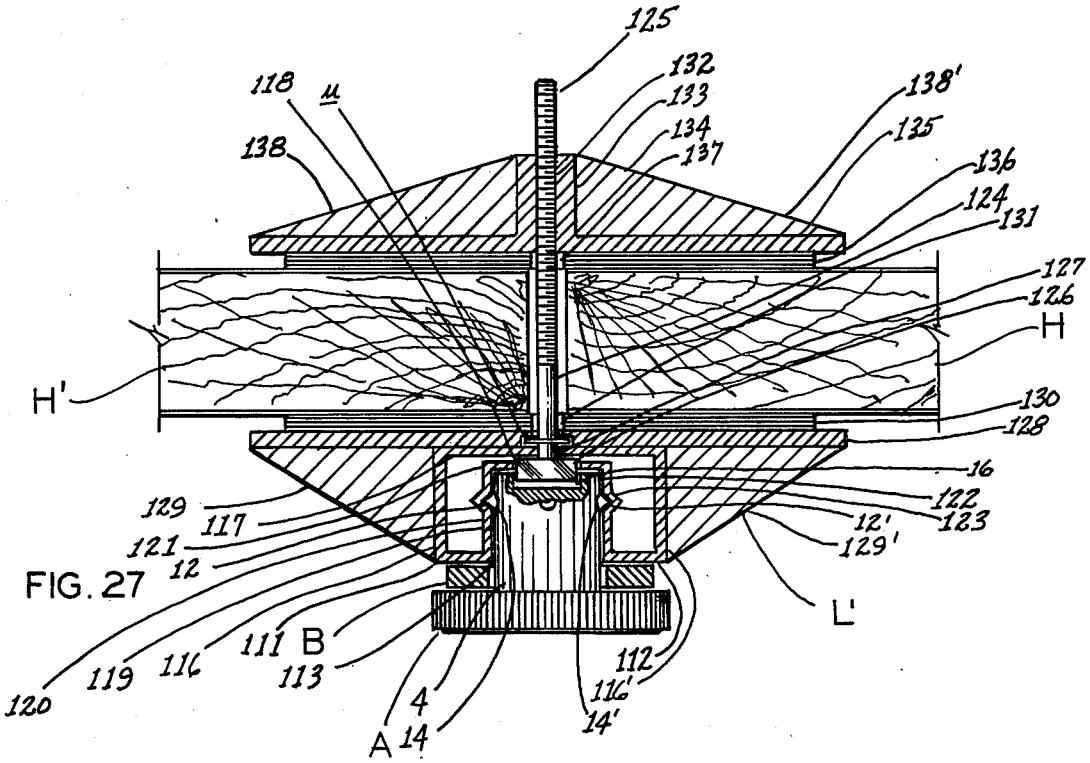
FIG. 27 is a horizontal transverse sectional view taken on the line 27—27 of FIG. 26, but showing the auxiliary lock in plan view.
Figure 28:
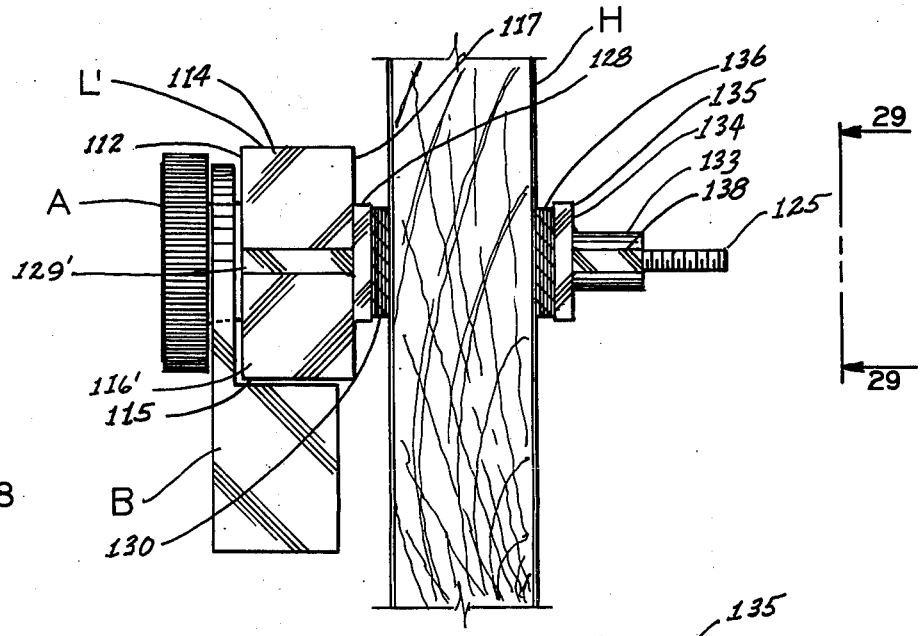
FIG. 28 is a side elevational view taken on the line 28—28 of FIG. 26.
Figure 29:
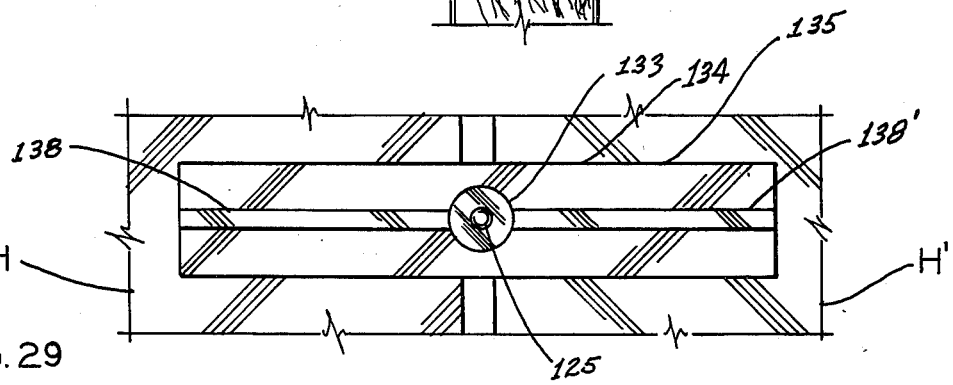
FIG. 29 is a rear elevational view taken on the line 29—29 of FIG. 28.

Turning more particularly to FIGS. 25 and 27, it will be seen that lock L' incorporates lock body A which is received within a housing 111 comprising a front wall 112 which contains a central opening 113 through which casing 4 extends, top and bottom parallel walls 114,115, parallel side walls 116,116', and a rear wall 117 having a central opening 118. Extending inwardly from front wall opening 113 is socket-forming element 119 having a cylindrical side wall 120 and an inner end or base wall 121 for developing a chamber 122 within which lock body casing 4 extends; there being a radially outwardly projecting, annular series of conically-shaped receivers 123 for arms 12,12' of lock body A when the same are in extended condition through the aligned apertures 14,14' as the case may be. Extending through opening 118 is the forward end of the stem 124 of a screw 125 having an enlarged head 126 disposed within chamber 122 for acceptance within socket 16 of lock body A. Said screw 125 projects through an opening 127, which latter registers with opening 118, in a base plate 128 rigid with housing rear wall 117 and extending laterally beyond said side walls 116,116' thereof. Said latter side walls 116,116' are integral with gusset or fin-like members 129,129' which interconnect said last mentioned side walls with the forward face of base plate 128 for rigidifying purposes. Suitably affixed, as by cementitious material, to the rearward face of base plate 128 is a friction pad 130 having a central opening 131 aligned with openings 127 and 118 for passage therethrough of screw stem 124; encircling said latter within opening 127 is a retaining collar *u* to inhibit any potential for screw 125 to be moved accidentally axially.

At its head remote end, screw 125 is threadedly engaged within a tapped bore 132 provided within the central tubular portion 133 of a companion element 134, which latter comprises a front plate 135 integral with the forward end of tubular portion 133 and projecting in opposite lateral directions therefrom; said front plate 135 being preferably of like area and contour as base plate 128. Secured upon the forward face of plate 135 is a friction pad 136 having a central opening 137 aligned with bore 132 for extension therethrough of screw stem 124. On diametrally opposed sides of tubular portion 133 fin-like elements 138,138' are presented for interconnecting said tubular portion with the rear face of front plate 135 thereby strengthening the structure of companion member 134.

It will thus be seen that companion member 134 may be relatively loosened with respect to screw 125 so as to increase the distance between friction pads 130,136 for facilitating disposition upon the doors to be closed, such as doors H,H' shown in FIG. 27, for purposes of illustration; it being recognized that auxiliary lock L' is equally useful with any of the door types shown in FIGS. 19, 21, and 23. With suitable spacing between friction pads 130 and 136, auxiliary lock L' may be turned through an angle of 90° from that shown in FIGS. 25-29 wherein said pads 130,136 and related components will have their major axes vertically and thus present requisite clearance so that doors H,H' may be easily received therebetween in closed condition. It will thus be observed that screw 124 will extend between the confronting free edges of the cooperating doors H,H'. With the doors in closed condition, the user may then return said lock L' through an angle of 90°, into the position shown in FIG. 27 wherein said friction pads 130,136 have their major axes horizontal. The user will then pull forwardly upon lock body A or housing 111, whichever is convenient, so as to draw friction pad 136 into snug friction-producing engagement against the inner or rear faces of doors H,H'. Accordingly, with outward pressure being applied, lock body A is suitably turned so as to effect threading of screw 125 within bore 132 for drawing friction pad 130 into tight abutment on its rearward face against the forward face of doors H,H'. With doors H,H' being accordingly tightly engaged between the said pads 130,136, the user will then latch lock body A by operation of key 10.

As FIGS. 25-28 reveal, anti-distortion device B is engageable upon lock body A in the customary manner and is appropriately handled during application of locks L,L′ in operative condition so as to inhibit any accidental energization thereof.

Thus, auxiliary lock L′, as shown, is extremely versatile in usage; the foregoing demonstrating the applicability of lock body A within an expendient for securing cooperating, edge-butting doors.

In actuality, in the installation of locks L,L′, all locking operations are preferably completed prior to disposing anti-distortion device B in operative position. Thus, after utilizing lock body A as a tool for tightening of the related screw, the same is withdrawn, anti-distortion device B suitably placed, and then lock body A reinserted with consequent latching by key 10. By this method accidental premature energization of anti-distortion device B is obviated.

Having described my invention, what I claim and desire to obtain by Letters Patent is:

1. An auxiliary door lock comprising a lock body having means defining a casing, means defining a housing receiving said lock body casing for rotational movement of the latter within the former, means latchably interengaging said casing and said housing in selected relative position, an elongated element engaged to said casing for axially linear movement responsive to rotation of said casing, means defining a sleeve rigid with said housing and having its major axis normal to the longitudinal axis of said lock body, a toothed member freely extending through said sleeve for projection at its ends therebeyond, and cooperating means comprising a component carried on said elongated element interengageable with said toothed member for maintaining same in selected relative position in said sleeve, and means provided on one end of said toothed member engageable with the door to be locked.

2. An auxiliary door lock as defined in claim 1 and further characterized by a flange formed on one end of said sleeve, and a tongue provided on the end of said toothed member at the end thereof corresponding to the end of said sleeve carrying said flange.

3. An auxiliary door lock as defined in claim 1 and further characterized by a stop flange formed on one end of said sleeve, and a hook-forming device engageable with a door to be locked provided on the end of said toothed member at the end thereof corresponding to the end of said sleeve carrying said flange.

4. An auxiliary door lock as defined in claim 3 and further characterized by said flange and said tongue extending away from each other.

5. An auxiliary door lock as defined in claim 2 and further characterized by said component being a compressor plate having a serrated surface confronting said toothed member interengageable therewith.

6. An auxiliary door lock as defined in claim 2 and further characterized by said casing having a receptacle at end, means communicating said receptacle through said housing with the interior of said sleeve, said elongated element having a head portion and a stem portion, said head portion being fittedly received with said receptacle whereby upon rotation of said casing said elongated element would be rotated about its longitudinal axis, said component being carried on the end of said stem remote from said head.

7. An auxiliary door lock as defined in claim 6 and further characterized by means mounting said component on said elongated element whereby upon rotation of the latter said component is movable linearly toward and away from said toothed member.

8. An auxiliary door lock as defined in claim 7 and further characterized by said elongated element stem portion being externally threaded, said housing having an internally threaded opening in which said stem is engaged.

9. An auxiliary door lock as defined in claim 3 and further characterized by said hook-forming device including a pair of parallel spaced apart arms, a web interconnecting said arms at their ends remote from said sleeve.

10. An auxiliary door lock as defined in claim 9 and further characterized by a clamping member, means mounting said clamping member on one of said arms for movement toward and away from said other of said arms to cooperate therewith in door-gripping and door-releasing relationship respectively.

11. An auxiliary door lock as defined in claim 3 and further characterized by said hook-forming device including a pair of parallel spaced apart arms, a web axially parallel to the longitudinal axis of said toothed member interconnecting said arms at one of their ends, a clamping member, and swivel means mounting said clamping member on one of said arms.

12. An auxiliary door lock as defined in claim 11 and further characterized by means adapting said clamping member axially reciprocally adjustable with respect to said swivel means.

13. An auxiliary door lock as defined in claim 9 and further characterized by said arms being axially parallel with the longitudinal axis of said toothed member, and said web being axially normal to the longitudinal axis of said toothed member.

14. An auxiliary door lock as defined in claim 9 and further characterized by said arms being axially normal to the longitudinal axis of said toothed member and said web being axially parallel to the longitudinal axis of said toothed member.

* * * * *